United States Patent [19]

Curtis

[11] Patent Number: 4,989,862

[45] Date of Patent: Feb. 5, 1991

[54] BASKETBALL GAME PRACTICE DEVICE

[76] Inventor: Michael Curtis, 911 Skeet Club Rd., High Point, N.C. 27260

[21] Appl. No.: 409,705

[22] Filed: Sep. 20, 1989

[51] Int. Cl.[5] ..... A63B 69/34; A63B 71/04; A63H 3/46; A63H 15/06

[52] U.S. Cl. ..... 273/1.5 A; 272/76; 446/326; 446/381

[58] Field of Search ..... 273/1.5 R, 1.5 A, 85 R; 223/66; 272/76; 446/325, 326, 396, 380, 381

[56] References Cited

U.S. PATENT DOCUMENTS

| | | | |
|---|---|---|---|
| 268,020 | 11/1882 | Howard | 223/66 |
| 396,938 | 1/1889 | Kemmler | 272/76 |
| 419,285 | 1/1890 | Sanborn | 272/76 |
| 624,799 | 5/1899 | Haueis | 223/66 |
| 1,604,206 | 10/1926 | Tilton | 446/381 |
| 2,909,370 | 10/1959 | Fortney | 223/66 |
| 3,387,842 | 6/1968 | Edgar | 272/76 |
| 3,552,749 | 1/1971 | Piggotte | 273/1.5 A |
| 3,576,323 | 4/1971 | Pellicer | 273/1 F |
| 3,592,470 | 7/1971 | Breslow | 273/1.5 R |
| 3,675,921 | 7/1972 | Meyers, Sr. | 273/1.5 A |
| 3,804,406 | 4/1974 | Visaone | 273/1.5 A |
| 3,868,108 | 2/1975 | Kirchner | 273/1.5 A |
| 4,168,062 | 9/1979 | McCarthy et al. | 273/1 B |

*Primary Examiner*—Benjamin Layno

[57] ABSTRACT

A device which simulates a defensive basketball player for practicing offensive moves such as shooting is formed from a resilient, durable synthetic foam. The device can be selectively adjusted to various heights and the arms are manually rotatable in order for an offensive player to sharpen his shooting skills without the necessity of an opponent being present.

16 Claims, 2 Drawing Sheets

BASKETBALL GAME PRACTICE DEVICE

BACKGROUND OF THE INVENTION

1. Field Of The Invention

The invention herein pertains to basketball game practice device and specifically to devices which simulate defensive opponents so the user can practice and sharpen offensive skills.

2. Description Of The Prior Art And Objectives Of The Invention

To become an accomplished basketball player many hours of practice are required on the court under actual playing conditions. However, basketball players must also practice shooting and other offensive skills alone in order to become proficient. While shooting practice alone is beneficial, many players can become consistent in making baskets from a particular position on the court, only to lose their accuracy under game or guarded conditions. One of the reasons for this is in practicing alone shooters do not have an opposing player to obstruct their path or view of the basket as is the case under game conditions. As it is oftentimes difficult to find a person who will act as a defensive player for extended periods of time needed for practicing offensive goal shooting skills, the present invention was conceived and one of its objectives is to provide a defensive device for use by practicing offensive basketball players.

It is yet another objective of the present invention to provide a device in the form of a simulated player having an upper and a lower torso with arms and legs affixed thereto.

It is another objective of the present invention to provide a simulated basketball player form which can be adjusted so the height of the form can be varied according to the particular offensive player's height and needs.

It is still another objective of the present invention to provide a defensive device which includes individually rotatable arms for placement at a variety of positions.

It is also an objective of the present invention to provide a defensive device for use by practicing offensive basketball players which includes resilient lower limbs and stabilizers affixed thereto whereby bumps or contact with the defensive player form will not knock down or substantially move the defensive form.

Various other objectives and advantages of the present invention become apparent to those skilled in the art as a more detailed description is presented below.

SUMMARY OF THE INVENTION

The aforesaid and other objectives can be realized by providing a basketball game practicing device in the form of a simulated defensive opponent which includes an upper and lower torso joined by a means to adjust the height therebetween. The lower limbs or legs of the device are also separated at approximately the "knees" and a means to adjust the height of the legs is positioned therein. The upper limbs or arms are adjustably rotatable at the "shoulders" on the upper torso whereby the arms with attached hands can be lowered or raised, depending on the desires of the player practicing offensive skills. The simulated player form is constructed of a dense synthetic polyurethane foam or the like and is lightweight so as to be easily carried by an individual player for assembly and adjustment on a basketball court with little time or effort.

DESCRIPTION OF THE PREFERRED EMBODIMENT

Figure 1:
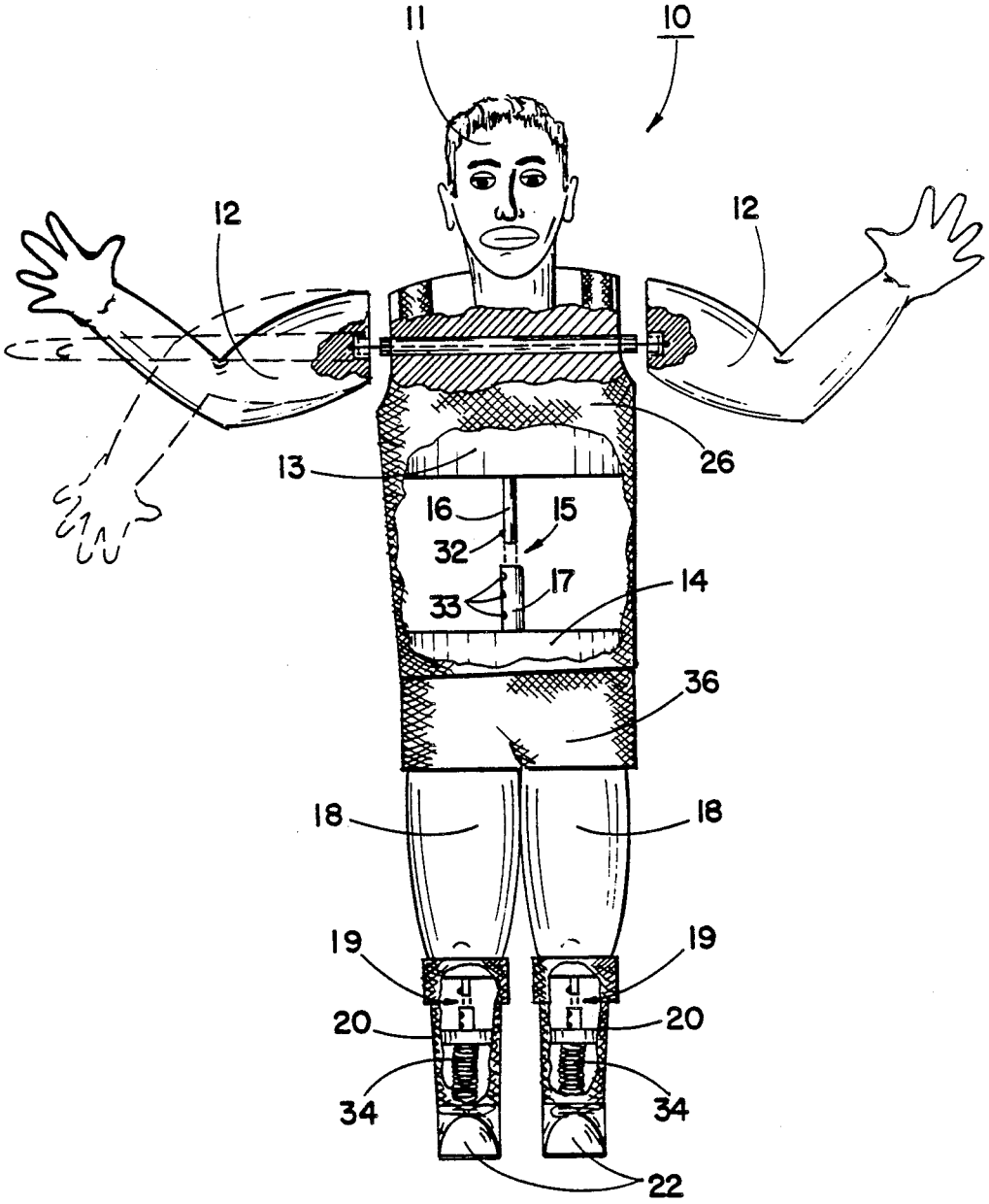
FIG. 1 demonstrates in cutaway fashion a simulated defensive player form having height adjustment mechanisms at the mid-torso and in the legs.

The preferred form of the invention as seen in FIG. 1 whereby a defensive player form is molded from a polyurethane foam to simulate a defensive basketball player. In use, the form is assembled, its height adjusted and placed on a basketball court whereby an offensive player can dribble towards the form, stop and shoot over the form as would occur with a defensive opponent during game conditions. The arms of the form are rotatably affixed to the upper torso whereby each arm can be raised or lowered individually. The torso is divided into upper and lower sections with a telescoping adjusting mechanism therebetween. Also, the legs have telescoping adjusting mechanisms within for additional height adjustment. Resilient members in the form of springs are within the lower legs of the device whereby, bumping or knocking the form during practice will not substantially move it or knock it down. Stabilizers are affixed to the lower extremities or feet of the defensive form which also help in preventing the form from being upset and moved during practice contact. The arms are held onto the torso by a resilient strap which may be formed from elastic fibers or otherwise to maintain the arms in their temporarily fixed position.

DETAILED DESCRIPTION OF THE DRAWINGS AND OPERATION OF THE INVENTION

For a better understanding of the invention and its method of use, turning now to the drawings, FIG. 1 depicts defensive basketball player form 10 having a head 11 and upper limbs or arms 12 which are rotatably attached to upper torso 13. Upper torso 13 is joined to lower torso 14 by a telescoping means 15 to adjust the height therebetween which includes a cylindrical extension 16 and an extension receiver 17. Tension pin 32 is positioned within cylindrical extension 16. Player form 10 is made from polyurethane foam or other similar material which is both lightweight and durable. Lower torso 14 is connected to lower limbs or legs 18 which include leg height adjusting means 19 seen within cutaway socks 20 of FIG. 1. Telescoping adjusting means 19 is of course used to adjust the height or length of legs 18.

Figure 4:
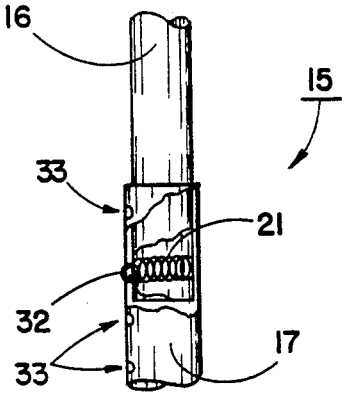
FIG. 4 depicts the telescoping height adjustment mechanism such as positioned between the upper and lower torso of the player form.

In FIG. 4, height adjusting means 15 is shown with tension spring 21 which urges tension pin 32 into one (1) of a plurality of openings 33 along extension receiver 17. As would be understood, telescoping adjusting means 19 operates in an identical manner to height adjusting means 15 as seen in FIG. 4 enlarged for clarity.

In FIG. 4, tension pin 32 can be urged inwardly, out of opening 33, by thumb pressure and cylindrical extension 16 is then slid upwardly or downwardly within extension receiver 17 to the desired height with pin 32 locking into the desired opening 33 of receiver 17. Leg adjusting means 19 operates in the same manner for an additional height adjustment of form 10. Height adjusting means 15 may provide twelve to eighteen (12–18) inches of adjustment distance whereas height adjusting means 19 may provide only six to twelve (6–12) inches. Thus, by providing two (2) different height adjusting means within form 10, the user can better simulate a player having either long legs or a longer upper torso to better represent a particular opponent of an upcoming basketball game as different defensive players may be built differently and require different shooting techniques for the best offensive results.

Coil springs 34 are mounted in the approximate ankle portion of legs 18 as seen in FIG. 1 and allow form 10 to pivot back and forth such as when bumped during a shooting exercise. Coil springs 34 may be formed of conventional spring steel construction and are concealed within the polyurethane foam of form 10.

Figure 5:
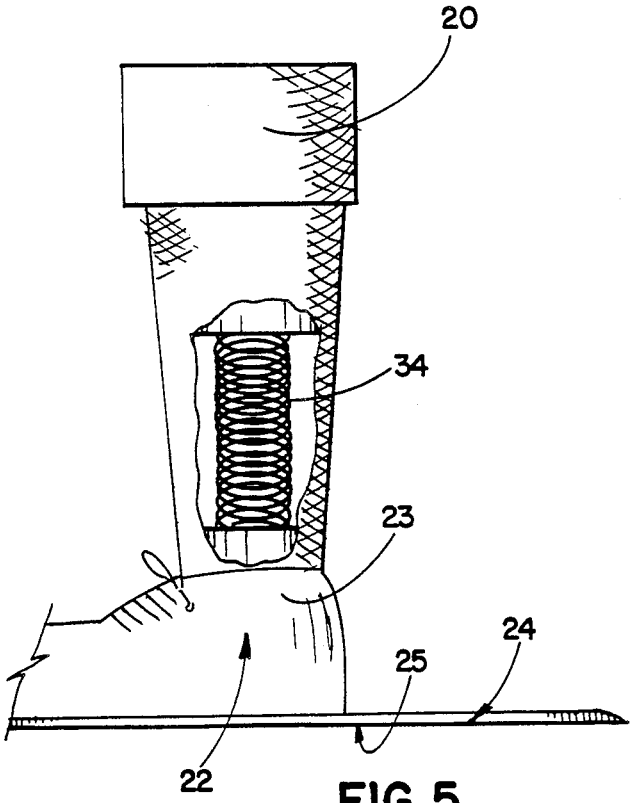
FIG. 5 pictures in cutaway fashion the resilient member in the lower limb along with the form stabilizer.

Lower extremity 22 as shown in FIG. 5 is fitted with basketball shoe 23 shown in fragmented fashion and affixed to the bottom of shoe 23 is a means 24 to assist in stabilizing form 10 during contact as occurs during practice sessions. Stabilizing means 24 may comprise a metal strip extending approximately eighteen (18) inches rearward of lower extremity 22 as shown in FIG. 5 and includes a flat, smooth lower surface 25 which rests on the floor of the basketball court or the like.

Figure 2:
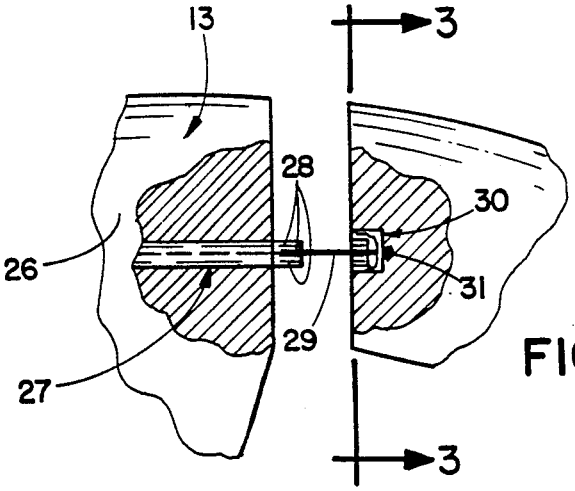
FIG. 2 illustrates in cutaway fashion a portion of the upper arm with the arm separated from the torso.
Figure 3:
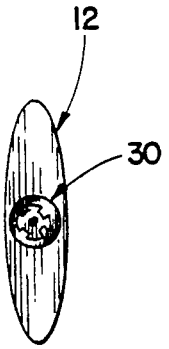
FIG. 3 shows the spline shaft receiver within the arm as seen through lines 3—3 of FIG. 2.

To improve the operator's shooting skills, form 10 includes rotatable upper limbs or arms 12 which can be positioned in an infinite variety of settings. As seen in FIG. 2, a portion of upper torso 13 is cut away revealing spline shaft 27 with splines 28 at the terminal end thereof. Resilient rubber strap 29 extends through spline shaft and shaft receiver 30 and is held under tension by strap pin 31 at the rear of shaft receiver 30. To adjust arms 12 to the desired position, arm 12 is pulled outwardly from torso 13, thus placing additional tension on strap 29, whereby shaft receiver 30 disengages from spline shaft 27. Arm 12 is then rotated to the desired position and with the release of arm 12, strap 29 pulls arm 12 whereby splines 28 again engage receiver 30 and arm 12 remains so positioned until further manual adjustment is desired. FIG. 3 shows the outer configuration of arm 12 as seen in FIG. 2 with receiver 30 mounted therein.

Shirt 26, pants 36 and sock 20 are shown to illustrate a typical form 10 dress although other garments or uniforms could be used if advantageous.

The illustrations and examples provided herein are for explanatory purposes and are not intended to limit the scope of the appended claims.

I claim:

1. A device for use by practicing basketball players which appears as a defensive opponent comprising: a simulated player form, said form having an upper and a lower torso, a first pair of limbs, said first pair of limbs attached to said upper torso, a second pair of limbs, said second pair of limbs attached to said lower torso, height adjusting means, said height adjusting means attached to said player form, said height adjusting means comprising a telescoping assembly, and said telescoping assembly including a tension pin.

2. A device for use by practicing basketball players as claimed in claim 1 wherein said height adjusting means is positioned between said upper and said lower torso.

3. A device for use by practicing basketball players as claimed in claim 1 and including leg adjusting means, said leg adjusting means affixed to one of said second pair of limbs.

4. A device for use by practicing basketball players as claimed in claim 3 wherein said leg adjusting means are affixed to each of said second pair of limbs.

5. A device for use by practicing basketball players as claimed in claim 3 wherein said leg adjusting means includes a telescoping assembly.

6. A device for use by practicing basketball players as claimed in claim 1 wherein one of said first pair of limbs is rotatably affixed to said upper torso.

7. A device for use by practicing basketball players as claimed in claim 1 and including means to allow said form to pivot in the event of contact therewith, wherein said pivoting means comprising a pair of resilient members, one of said pair of resilient members enclosed in each of said second pair of limbs.

8. A device for use by practicing basketball players as claimed in claim 1 and including a planar strip stabilizing means, said stabilizing means joined to one of said second pair of limbs.

9. A device for use by practicing basketball players as claimed in claim 8 wherein said stabilizing means extends rearward from said second pair of limbs.

10. A device for use by practicing basketball players as claimed in claim 1 wherein one of said first pair of limbs includes a shaft receiver.

11. A device for use by practicing basketball players as claimed in claim 1 wherein said first pair of limbs are joined by a resilient member.

12. A device for use by practicing basketball players as claimed in claim 1 wherein said player form is made from a synthetic foam.

13. A device for use by practicing basketball players as claimed in claim 1 wherein said height adjusting means comprises a telescoping assembly.

14. A device for use by practicing basketball players which appears as a defensive opponent comprising: a simulated player form, said form made from a synthetic material, said form having an upper torso, a pair of arms, said arms rotatably attached to said upper torso, said form having a lower torso, a pair of legs, said legs joined to said lower torso, means to adjust the height of said upper torso, said height adjusting means positioned between said upper and lower torso and affixed thereto, said height adjusting means comprising a telescoping assembly, said telescoping assembly including a tension pin, means to adjust the length of said legs, said leg adjusting means affixed to said legs, and planar strip means to stabilize said form during use, said stabilizing means extending rearwardly from said legs.

15. A device for use by practicing basketball players as claimed in claim 14 wherein said stabilizing means comprises a pair of planar strip means, each of said pair of strip means having a flat lower surface, said surface for contacting the floor when said form is in its upright position, one of each of said pair of planar strips connected to one of said pair of legs.

16. A device for use by practicing basketball players which appears as a defensive opponent comprising: a simulated player form, said form having an upper and lower torso, a first pair of limbs, a spline shaft, said spline shaft attached to said upper torso, said first pair of limbs attached to said spline shaft, a second pair of limbs, said second pair of limbs attached to said lower torso and height adjusting means, said height adjusting means attached to said player form.

* * * * *